US005351338A

United States Patent [19]

Wigren

[11] Patent Number: 5,351,338

[45] Date of Patent: Sep. 27, 1994

[54] TIME VARIABLE SPECTRAL ANALYSIS BASED ON INTERPOLATION FOR SPEECH CODING

[75] Inventor: Torbjorn K. Wigren, Uppsala, Sweden

[73] Assignee: Telefonaktiebolaget L M Ericsson, Stockholm, Sweden

[21] Appl. No.: 909,012

[22] Filed: Jul. 6, 1992

[51] Int. Cl.[5] ..... G10L 9/02

[52] U.S. Cl. ..... 395/2.28

[58] Field of Search ..... 381/29-53; 395/2.28-2.32

[56] References Cited

U.S. PATENT DOCUMENTS

| | | | |
|---|---|---|---|
| 4,015,088 | 3/1977 | Dubnowski et al. . | |
| 4,230,906 | 10/1980 | Davis . | |
| 4,443,859 | 4/1984 | Wiggins . | |
| 4,520,499 | 5/1985 | Montlick et al. . | |
| 4,703,505 | 10/1987 | Seiler et al. . | |
| 4,797,926 | 1/1989 | Bronson et al. | 381/36 |
| 4,821,324 | 4/1989 | Ozawa et al. . | |
| 4,885,790 | 12/1989 | McAulay et al. . | |
| 4,896,361 | 1/1990 | Gerson . | |
| 4,912,764 | 3/1990 | Hartwell et al. . | |
| 4,937,873 | 6/1990 | McAulay et al. . | |
| 5,007,094 | 4/1991 | Hsueh et al. . | |
| 5,038,097 | 8/1991 | Imanaka | 324/77 B |
| 5,054,072 | 10/1991 | McAulay et al. . | |
| 5,195,168 | 3/1993 | Yong | 395/2 |

FOREIGN PATENT DOCUMENTS 2205469A 12/1988 United Kingdom .

OTHER PUBLICATIONS

B. S. Atal et al., "Stochastic Coding of Speech Signals at Very Low Bit Rates", *Proc. Int. Conf. Comm. IC-C-84*, pp. 1610-1613 (Sep. 1984).

A. Benveniste, "Design of Adaptive Algorithms for the Tracking of Time-Varying Systems" *Int. J. Adaptive Control Signal Processing*, vol. 1, No. 1, pp. 3-29 (Apr. 1987).

T. A. C. G. Claasen et al., "The Wigner Distribution-A Tool for Time-Frequency Signal Analysis", *Philips J. Res.*, vol. 35, pp. 217-250, 276-300, 372-3899 (1980).

I. Daubechies, "Orthonormal Bases of Compactly Supported Wavelets," *Comm. Pure. Appl. Math.*, vol. 41, pp. 929-996 (Dec. 1988).

B. Friedlander, "Lattice Filters for Adaptive Processing", *Proc. IEEE*, vol. 70, pp. 829-867 (Aug. 1982).

Y. Grenier, "Time-dependent ARMA Modeling of Nonstationary Signals", *IEEE Trans. on Acoustics, Speech and Signal Processing*, vol. ASSP-31, No. 4, pp. 899-911 (Aug. 1983).

E. Karlsson, "RLS Polynomial Lattice Algorithms for Modelling Time-Varying Signals", *Proc. ICASSP*, pp. 3233-3236 (Jul. 1991).

W. B. Klijn et al., "Improved Speech Quality and Efficient Vector Quantization in Self" 1988 Int'l Conference on Acoustics, Spech, and Signal Processing, pp. 155-158 (Sep. 1988).

L. Ljung et al., "Fast Calculations of Gain Matrices for Recursive Estimation Schemes" *Int. J. Contr.*, vol. 27, pp. 1-19 (Dec. 1978).

L. Ljung et al., "Theory and Practice of Recursive Identification," Cambridge, Mass., M.I.T. Press, Chapters 2-3 (1983).

M. Morf et al., "Efficient Solution of Co-Variance Equations for Linear Prediction", *IEEE Trans. Acoust. Speech, Signal Processing*, vol. ASSP-25, pp. 429-433 (Oct. 1977).

L. R. Rabiner et al., "Digital Processing of Speech Signals," Prentice Hall, Chapter 8 (1978).

S. Singhal et al., "Improving Performance of Multi--Pulse LPC-Codecs at Low Bit Rates", *Proc. CASSP* (May, 1984) pp. 1.3.1-1.3.4.

*Primary Examiner*—Allen R. MacDonald
*Assistant Examiner*—Michelle Doerrler
*Attorney, Agent, or Firm*—Burns, Doane, Swecker & Mathis

[57] ABSTRACT

A time variable spectral analysis for speech coding based upon interpolation between speech frames. A speech signal is modeled by a linear filter which is obtained by a time variable linear predictive coding analysis algorithm. Interpolation between adjacent speech frames is used in order to express a time variation of the speech signal. In addition, interpolation between adjacent frames secures a continuous track of filter parameters across different speech frames.

71 Claims, 3 Drawing Sheets

TIME VARIABLE SPECTRAL ANALYSIS BASED ON INTERPOLATION FOR SPEECH CODING

FIELD OF THE INVENTION

The present invention relates to a time variable spectral analysis algorithm based upon interpolation of parameters between adjacent signal frames, with an application to low bit rate speech coding.

BACKGROUND OF THE INVENTION

In modern digital communication systems, speech coding devices and algorithms play a central role. By means of these speech coding devices and algorithms, a speech signal is compressed so that it can be transmitted over a digital communication channel using a low number of information bits per unit of time. As a result, the bandwidth requirements are reduced for the speech channel which, in turn, increases the capacity of, for example, a mobile telephone system.

In order to achieve higher capacity, speech coding algorithms that are able to encode speech with high quality at lower bit rates are needed. Recently, the demand for high quality and low bit rate has sometimes lead to an increase of the frame length used in the speech coding algorithms. The frame contains speech samples residing in the time interval that is currently being processed in order to calculate one set of speech parameters. The frame length is typically increased from 20 to 40 milliseconds.

As a consequence of the increase of the frame length, fast transitions of the speech signal cannot be tracked as accurately as before. For example, the linear spectral filter model that models the movements of the vocal tract, is generally assumed to be constant during one frame when speech is analyzed. However, for 40 millisecond frames, this assumption may not be true since the spectrum can change at a faster rate.

In many speech coders, the effect of the vocal tract is modeled by a linear filter, that is obtained by a linear predictive coding (LPC) analysis algorithm. Linear predictive coding is disclosed in "Digital Processing of Speech Signals," L. R. Rabiner and R. W. Schafer, Prentice Hall, Chapter 8, 1978, and is incorporated herein by reference. The LPC analysis algorithms operate on a frame of digitized samples of the speech signal, and produces a linear filter model describing the effect of the vocal tract on the speech signal. The parameters of the linear filter model are then quantized and transmitted to the decoder where they, together with other information, are used in order to reconstruct the speech signal. Most LPC analysis algorithms use a time invariant filter model in combination with a fast update of the filter parameters. The filter parameters are usually transmitted once per frame, typically 20 milliseconds long. When the updating rate of the LPC parameters is reduced by increasing the LPC analysis frame length above 20 ms, the response of the decoder is slowed down and the reconstructed speech sounds less clear. The accuracy of the estimated filter parameters is also reduced because of the time variation of the spectrum. Furthermore, the other parts of the speech coder are affected in a negative sense by the mismodeling of the spectral filter. Thus, conventional LPC analysis algorithms, that are based on linear time invariant filter models have difficulties with tracking formants in the speech when the analysis frame length is increased in order to reduce the bit rate of the speech coder. A further drawback occurs when very noisy speech is to be encoded. It may then be necessary to use long speech frames which contain many speech samples in order to obtain a sufficient accuracy of the parameters of the speech model. With a time invariant speech model, this may not be possible because of the formant tracking capabilities described above. This effect can be counteracted by making the linear filter model explicitly time variable.

Time variable spectral estimation algorithms can be constructed from various transform techniques which are disclosed in "The Wigner Distribution-A Tool for Time-Frequency Signal Analysis," T. A. C. G. Claasen and W. F. G. Mecklenbräuker, *Philips J. Res,* Vol. 35, pp. 217–250, 276–300, 372–389, 1980, and "Orthonormal Bases of Compactly Supported Wavelets," I. Daubechies, *Comm. Pure. Appl. Math,* Vol. 41, pp. 929–996, 1988, which are incorporated herein by reference. Those algorithms are, however, less suitable for speech coding since they do not possess the previously described linear filter structure. Thus, the algorithms are not directly interchangeable in existing speech coding schemes. Some time variability may also be obtained by using conventional time invariant algorithms in combination with so called forgetting factors, or equivalently, exponential windowing, which are described in "Design of Adaptive Algorithms for the Tracking of Time-Varying Systems," A. Benveniste, *Int. J. Adaptive Control Signal Processing,* Vol. 1, no. 1, pp. 3–29, 1987, which is incorporated herein by reference.

The known LPC analysis algorithms that are based upon explicitly time variant speech models use two or more parameters, i.e., bias and slope, to model one filter parameter in the lowest order time variable case. Such algorithms are described in "Time-dependent ARMA Modeling of Nonstationary Signals," Y. Grenier, *IEEE Transactions on Acoustics, Speech and Signal Processing,* Vol. ASSP-31, no. 4, pp. 899–911, 1983, which is incorporated herein by reference. A drawback with this approach is that the model order is increased, which leads to an increased computational complexity. The number of speech samples/free parameter decreases for fixed speech frame lengths, which means that estimation accuracy is reduced. Since interpolation between adjacent speech frames is not used, there is no coupling between the parameters in different speech frames. As a result, coding delays which extend beyond one speech frame cannot be utilized in order to improve the LPC parameters in the present speech frame. Furthermore, algorithms that do not utilize interpolation between adjacent frames, have no control of the parameter variation across frame borders. The result can be transients that may reduce speech quality.

SUMMARY OF THE DISCLOSURE

The present invention overcomes the above problems by utilizing a time variable filter model based on interpolation between adjacent speech frames, which means that the resulting time variable LPC-algorithms assume interpolation between parameters of adjacent frames. As compared to time invariant LPC analysis algorithms, the present invention discloses LPC analysis algorithms which improve speech quality in particular for longer speech frame lengths. Since the new time variable LPC analysis algorithm based upon interpolation allows for longer frame lengths, improved quality can be achieved in very noisy situations. It is important to note that no increase in bit rate is required in order to obtain these advantages.

The present invention has the following advantages over other devices that are based on an explicitly time varying filter model. The order of the mathematical problem is reduced which reduces computational complexity. The order reduction also increases the accuracy of the estimated speech model since only half as many parameters need to be estimated. Because of the coupling between adjacent frames, it is possible to obtain delayed decision coding of the LPC parameters. The coupling between the frames is directly dependent upon the interpolation of the speech model. The estimated speech model can be optimized with respect to the subframe interpolation of the LPC parameters which are standard in the LTP and innovation coding in, for example, CELP coders, as disclosed in "Stochastic Coding of Speech Signals at Very Low Bit Rates," B. S. Atal and M. R. Schroeder, *Proc. Int. Conf. Comm. ICC-84*, pp. 1610–1613, 1984, and "Improved Speech quality and Efficient Vector Quantization in SELP," W. B. Klijn, D. J. Krasinski, R. H. Ketchum, 1988 International Conference on Acoustics, Speech, and Signal Processing, pp.155–158, 1988, which are incorporated herein by reference. This is accomplished by postulating a piecewise constant interpolation scheme. Interpolation between adjacent frames also secures a continuous track of the filter parameters across frame borders.

The advantage of the present invention as compared to other devices for spectral analysis, e.g. using transform techniques, is that the present invention can replace the LPC analysis block in many present coding schemes without requiring further modification to the codecs.

BRIEF DESCRIPTION OF THE DRAWINGS

The present invention will now be described in more detail with reference to preferred embodiments of the invention, given only by way of example, and illustrated in the accompanying drawings, in which.

DETAILED DESCRIPTION OF THE PREFERRED EMBODIMENTS

Figure 1:
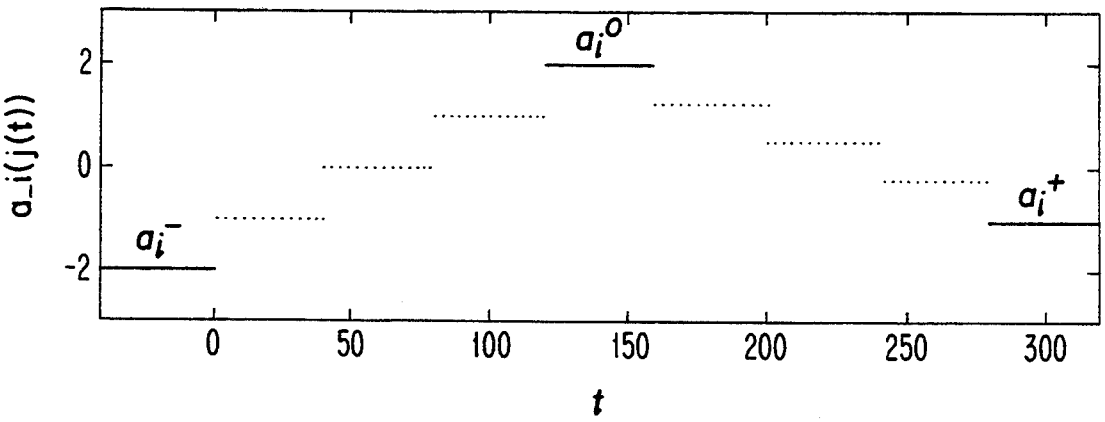
FIG. 1 illustrates the interpolation of one particular filter parameter, $a_i$.

While the following description is in the context of cellular communication systems involving portable or mobile telephone and/or personal communication networks, it will be understood by those skilled in the art that the present invention may be applied to other communication applications. Specifically, spectral analysis techniques disclosed in the present invention can also be used in radar systems, sonar, seismic signal processing and optimal prediction in automatic control systems.

In order to improve the spectral analysis, the following time varying all-pole filter model is assumed to generate the spectral shape of the data in every frame $$y(t) = \frac{1}{A(q^{-1},t)} e(t) \qquad \text{(eq. 1)}$$

Here y(t) is the discretized data signal and e(t) is a white noise signal. The filter polynomial $A(q^{-1},t)$ in the backward shift operator $q^{-1}$ ($q^{-k}e(t)=e(t-k)$) is given by $$A(q^{-1}, t)=1 + a_1(t)q^{-1}+\ldots + a_n(t)q^{-n} \qquad \text{(eq. 2)}$$

The difference as compared to other spectral analysis algorithms is that the filter parameters here will be allowed to vary in a new prescribed way within the frame, Since e(t) is white noise, it follows that the optimal linear predictor $\hat{y}(t)$ is given by $$\hat{y}(t)=-a_1(t)y(t-1)-\ldots -a_n(t)y(t-n) \qquad \text{(eq. 3)}$$

If the parameter vector $\bar{\theta}(t)$ and the regression vector $\phi(t)$ are introduced according to $$\bar{\theta}(t)=(a_1(t)\ldots a_n(t))^T \qquad \text{(eq. 4)}$$

$$\phi(t)=(-y(t-1)\ldots -y(t-n))^T \qquad \text{(eq. 5)}$$

then the optimal prediction of the signal y(t) can be formulated as $$y(t)=\bar{\theta}^2(t)\phi(t) \qquad \text{(eq. 6)}$$

In order to describe the spectral model in detail, some notation needs to be introduced. Below, the superscripts $()^-$, $()^0$ and $()^+$ refer to the previous, the present and the next frame, respectively.

N: the number of samples in one frame.

t: the t:th sample as numbered from the beginning of the present frame.

k: the number of subintervals used in one frame for the LPC-analysis.

m: the subinterval in which the parameters are encoded, i.e., where the actual parameters occur.

j: index denoting the j:th subinterval as numbered from the beginning of the present frame.

i: index denoting the i:th filter-parameter.

$a_i(j(t))$: interpolated value of the i:th filter parameter in the j:th subinterval. Note that j is a function of t.

$a_i(m-k)=a_i^-$: actual parameter vector in previous speech frame.

$a_i(m)=a_i^0$: actual parameter vector in present speech frame.

$a_i(m+k)=a_i^+$: actual parameter vector in next speech frame.

In the present embodiment, the spectral model utilizes interpolation of the a-parameter. In addition, it will be understood by one of ordinary skill in the art that the spectral model could utilize interpolation of other parameters such as reflection coefficients, area coefficients, log-area parameters, log-area ratio parameters, formant frequencies together with corresponding bandwidths, line spectral frequencies, arcsine parameters and autocorrelation parameters. These parameters result in spectral models that are nonlinear in the parameters.

The parameterization can now be explained from FIG. 1. The idea is to interpolate piecewise constantly between the subframes m−k, k and m+k. Note, however, that interpolation other than piecewise constant interpolation is possible, possibly over more than two frames. Note, in particular, that when the number of subintervals, k, equals the number of samples in one frame, N, then interpolation becomes linear. Since $a_i^-$ is known from the analysis of the previous frame, an algorithm can be formulated that determines the $a_i^0$ and (possibly) the $a_i^+$, by minimization of the sum of the squared difference between the data and the model output (eq. 1).

FIG. 1 illustrates interpolation of the i:th a-parameter. The dashed lines of the trajectory indicate subintervals where interpolation is used in order to calculate $a_i(j(t))$ where N=160 and k=m=4 in the figure.

The interpolation gives, e.g., the following expression for the i:th filter parameter:

$$a_i(j(t)) = a_i^- \frac{m - j(t)}{k} + a_i^0 \frac{k - m + j(t)}{k}, \quad m - k \leqq j(t) \leqq m \qquad \text{(eq. 7)}$$

$$a_i(j(t)) = a_i^0 \frac{k + m - j(t)}{k} + a_i^+ \frac{j(t) - m}{k}, \quad m \leqq j(t) \leqq m + k$$

It is convenient to introduce the following weight functions:

$$w^-(j(t),k,m) = \frac{2k - m + j(t)}{k}, \quad m - 2k \leqq j(t) \leqq m - k \qquad \text{(eq. 8)}$$

$$w^-(j(t),k,m) = \frac{m - j(t)}{k}, \quad m - k \leqq j(t) \leqq m$$

$$w^-(j(t),k,m) = 0, \text{ otherwise}$$

$$w^0(j(t),k,m) = \frac{k - m + j(t)}{k}, \quad m - k \leqq j(t) \leqq m \qquad \text{(eq. 9)}$$

$$w^0(j(t),k,m) = \frac{k + m - j(t)}{k}, \quad m \leqq j(t) \leqq m + k$$

$$w^0(j(t),k,m) = 0, \text{ otherwise}$$

$$w^+(j(t),k,m) = \frac{-m + j(t)}{k}, \quad m \leqq j(t) \leqq m + k \qquad \text{(eq. 10)}$$

$$w^+(j(t),k,m) = \frac{2k + m - j(t)}{k}, \quad m + k \leqq j(t) \leqq m + 2k$$

$$w^+(j(t),k,m) = 0, \text{ otherwise}$$

Figure 2:
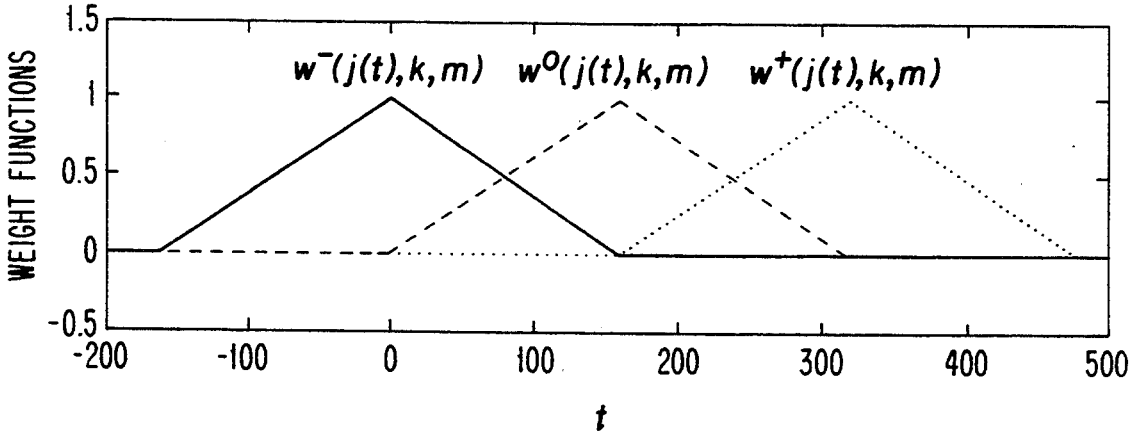
FIG. 2 illustrates weighting functions used in the present invention.

FIG. 2 illustrates the weight functions $w^-(t,N,N)$, $w^0(t,N,N)$ and $w^+(t,N,N)$ for N=160. Using equations (eq. 7)–(eq. 10), it is now possible to express the $a_i(j(t))$ in the following compact way $$a_i(j(t)) = w^-(j(t),k,m)a_i^- + w^0(j(t),k,m)a_i^0 + w^+(j(t),k,m)a^+_i \qquad \text{(eq. 11)}$$

Note that (eq. 6) is expressed in terms of $\bar{\theta}(t)$, i.e., in terms of the $a_i(j(t))$. Equation (eq. 11) shows that these parameters are in fact linear combinations of the true unknowns, i.e., $a_i^-$, $a_i^0$ and $a_i^+$. These linear combinations can be formulated as a vector sum since the weight functions are the same for all $a_i(j(t))$. The following parameter vectors are introduced for this purpose:

$$\theta = (a_1^- \ldots a_n^-)^T \qquad \text{(eq. 12)}$$

$$\theta^0 = (a_1^0 \ldots a_n^0) \qquad \text{(eq. 13)}$$

$$\theta^+ = (a_1^+ \ldots a_n^+)^T \qquad \text{(eq. 14)}$$

It then follows from equation (eq. 11) that $$\bar{\theta}(j(t)) = w^-(j(t),k,m)\theta^- + w^0(j(t),k,m)\theta^0 = w^=(j(t),k,m)\theta^+ \qquad \text{(eq. 15)}$$

Using this linear combination, the model (eq. 6) can be expressed as the following conventional linear regression $$\hat{y}(t) = \theta^T \phi(t) \qquad \text{(eq. 16)}$$

where $$\theta = (\theta^{-T}\theta^{0T}\theta^{+T})^T \qquad \text{(eq. 17)}$$

$$\phi(t) = [w^-(j(t),k,m)\phi^T(t)\ w^0(j(t),k,m)\phi^T(t)\ w^+(j(t),k,m)\phi^T(t)]^T \qquad \text{(eq. 18)}$$

This completes the discussion of the model.

Spectral smoothing is then incorporated in the model and the algorithm. The conventional methods, with pre-windowing, e.g. a Hamming window, may be used. Spectral smoothing may also be obtained by replacement of the parameter $a_i(j(t))$ with $a_i(j(t))/\rho^i$ in equation (eq. 6), where $\rho$ is a smoothing parameter between 0 and 1. In this way, the estimated a-parameters are reduced and the poles of the predictor model are moved towards the center of the unit circle, thus smoothing the spectrum. The spectral smoothing can be incorporated into the linear regression model by changing equations (eq. 16) and (eq. 18) into $$y(t) = \theta^T \phi_p(t) \qquad \text{(eq. 19)}$$

$$\phi_p^T(t) = (w^-(j(t),k,m)\phi^T_p(t)\ w^0(j(t),k,m)\phi_p^T(t)\ w^+(j(t),k,m)\phi_p^T(t)) \qquad \text{(eq. 20)}$$

where $$\phi_p(t) = (-\rho^{-1}y(t-1) \ldots -\rho^{-n}y(t-n))^T \qquad \text{(eq. 21)}$$

Another class of spectral smoothing techniques can be utilized by windowing of the correlations appearing in the systems of equations (eq. 28) and (eq. 29) as described in "Improving Performance of Multi-Pulse LPC-Codecs at Low Bit Rates," S. Singhal and B. S. Atal, *Proc. ICASSP*, 1984, which is incorporated herein by reference.

Since the model is time variable, it may be necessary to incorporate a stability check after the analysis of each frame. Although formulated for time invariant systems, the classical recursion for calculation of reflection coefficients from filter parameters has proved to be useful. The reflection coefficients corresponding to, e.g., the estimated $\theta^0$-vector are then calculated, and their magnitudes are checked to be less than one. In order to cope with the time-variability a safety factor slightly less than 1 can be included. The model can also be checked for stability by direct calculation of poles or by using a Schur-Cohn-Jury test.

If the model is unstable, several actions are possible. First, $a_i(j(t))$ can be replaced with $\lambda^i a_i(j(t))$, where $\lambda$ is a constant between 0 and 1. A stability test, as described above, is then repeated for smaller and smaller $\lambda$, until the model is stable. Another possibility would be to calculate the poles of the model and then stabilize only the unstable poles, by replacement of the unstable poles with their mirrors in the unit circle. It is well known that this does not affect the spectral shape of the filter model.

The new spectral analysis algorithms are all derived from the criterion $$V_\rho(\theta) = \sum_{t\in I} \epsilon_\rho^2(t,\theta) = \sum_{t\in I} (y(t) - \theta^T\phi_\rho(t))^2 \quad \text{(eq. 22)}$$

where $$I = [t_1, t_2] \quad \text{(eq. 23)}$$

is the time interval over which the model is optimized. Note that n extra samples before t are used because of the definition of $\phi(t)$. Using I, a delay can be used in order to improve quality. As stated previously, it is assumed that $\theta-$ is known from the analysis of the previous frame. This means that the criterion $V_\rho(\theta)$ can be written as $$V_\rho(\theta^{0+}) = \sum_{t\in I} \{(\bar{y}(t) - \theta^{-T}w^-(j(t),k,m)\phi_\rho(t)) - \theta^{0+T}\phi_\rho^{0+}(t)\}^2 = \sum_{t\in I} (y(t) - \theta^{0+T}\phi_\rho^{0+}(t))^2 \quad \text{(eq. 24)}$$

where $\bar{y}(t)$ is a known quantity and where $$\theta^{0+} = (\theta^{0T}\theta^{+T})^T \quad \text{(eq. 25)}$$

$$\phi_p^{0+}(t) = (w^0(j(t),k,m)\phi^T_p(t)\ w^+(j(t),k,m)\phi^T_p(t))^T \quad \text{(eq. 26)}$$

It is straightforward to introduce exponential weighting factors into the criterion, in order to obtain exponential forgetting of the old data.

The case, where the size of the optimization interval I is such that the speech model is affected by the parameters in the next speech frame, is treated first. This means that also $\theta+$ needs to be calculated in order to obtain the correct estimate of $\theta 0$. It is important to note that although $\theta+$ is calculated, it is not necessary to transmit it to the decoder. The price paid for this is that the decoder introduces an additional delay since speech can only be reconstructed until subinterval m of the present speech frame. Thus the algorithm can also be interpreted as a delayed decision time variable LPC-analysis algorithm. Assuming a sampling interval of $T_s$ seconds, the total delay introduced by the algorithm, counted from the beginning of the present frame, is $$\text{Delay} = \left(1 - \frac{m}{k}\right)NT_s + t_2T_s,\ t_2 > \frac{mN}{k} \quad \text{(eq. 27)}$$

The minimization of the criterion (eq. 24) follows from the theory of least squares optimization of linear regressions. The optimal parameter vector $\theta^{0+}$is therefore obtained from the linear system of equations $$\left(\sum_{t\in I} \phi_\rho^{0+}(t)\phi_\rho^{0+T}(t)\right)\theta^{0+} = \sum_{t\in I} \bar{y}(t)\phi_\rho^{0+}(t) \quad \text{(eq. 28)}$$

The system of equations (eq. 28) can be solved with any standard method for solving such systems of equations. The order of equation (eq. 28) is 2n.

Figure 3:
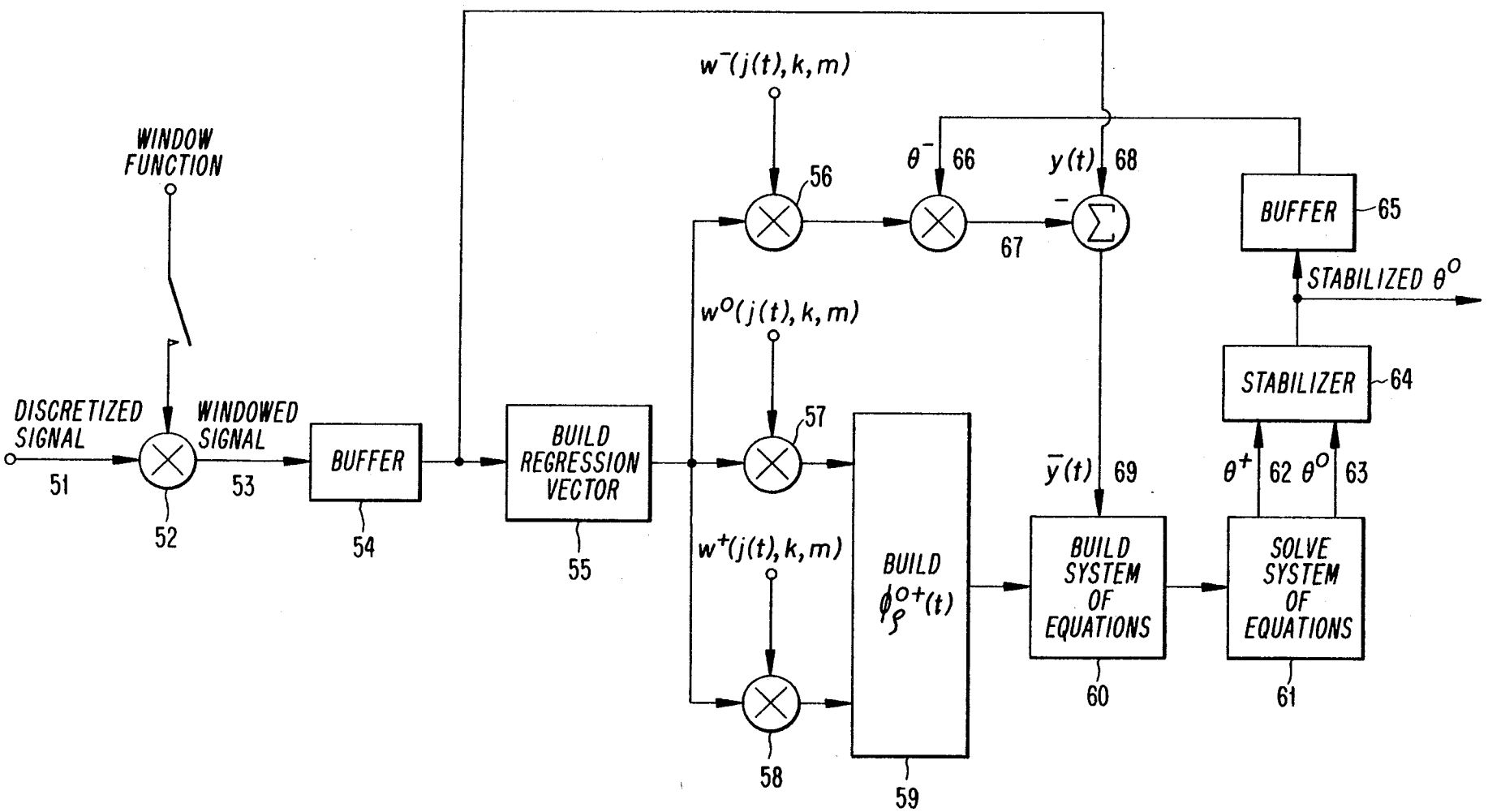
FIG. 3 illustrates a block diagram of one particular algorithm obtained from the present invention.

FIG. 3 illustrates one embodiment of the present invention in which the Linear Predictive Coding analysis method is based upon interpolation between adjacent frames. More specifically, FIG. 3 illustrates the signal analysis defined by equation 28 (eq. 28), using Gaussian elimination. First, the discretized signals may be multiplied with a window function 52 in order to obtain spectral smoothing. The resulting signal 53 is stored on a frame based manner in a buffer 54. The signal in the buffer 54 is then used for the generation of regressor or regression vector signals 55 as defined by equation (eq. 21). The generation of regression vector signals 55 utilizes a spectral smoothing parameter to produce a smoothed regression vector signals. The regression vector signals 55 are then multiplied with weighting factors 57 and 58, given by equations 9 and 10 respectively, in order to produce a first set of signals 59. The first set of signals are defined by equation (eq. 26). A linear system of equations 60, as defined by equation (eq. 28), is then constructed from the first set of signals 59 and a second set of signals 69 which will be discussed below. In this embodiment, the system of equations is solved using Gaussian elimination 61 and results in parameter vector signals for the present frame 63 and the next frame 62. The Gaussian elimination may utilize LU-decomposition. The system of equations can also be solved using QR-factorization, Levenberg-Marqardt methods, or with recursive algorithms. The stability of the spectral model is secured by feeding the parameter vector signals through a stability correcting device 64. The stabilized parameter vector signal of the present frame is fed into a buffer 65 to delay the parameter vector signal by one frame.

The second set of signals 69 mentioned above, are constructed by first multiplying the regression vector signals 55 with a weighting function 56, as defined by equation (eq. 8). The resulting signal is then combined with a parameter vector signal of the previous frame 66 to produce the signals 67. The signals 67 are then combined with the signal stored in buffer 54 to produce a second set of signals 69, as defined by equation (eq. 24).

When I does not extend beyond subinterval m of the present frame, $w^+(j(t),k,m,)$ equals zero and it follows from equations (eq. 25) and (eq. 26) that the right and left hand sides of the last n equations of (eq. 28) reduce to zero. The first n equations constitute the solution to the minimization problem as follows $$\left(\sum_{t\in I} w^{02}(j(t),k,m)\phi_\rho(t)\phi_\rho^T(t)\right)\theta^0 = \sum_{t\in I} \bar{y}(t)w^0(j(t),k,m)\phi_\rho(t) \quad \text{(eq. 29)}$$

As above, this is a standard least squares problem where the weighting of the data has been modified in order to capture the time-variation of the filter parameters. The order of equation (eq. 29) is n as compared to 2n above. The coding delay introduced by equation (eq. 29) is still described by equation (eq. 27) although now $t_2 < mN/k$.

Figure 4:
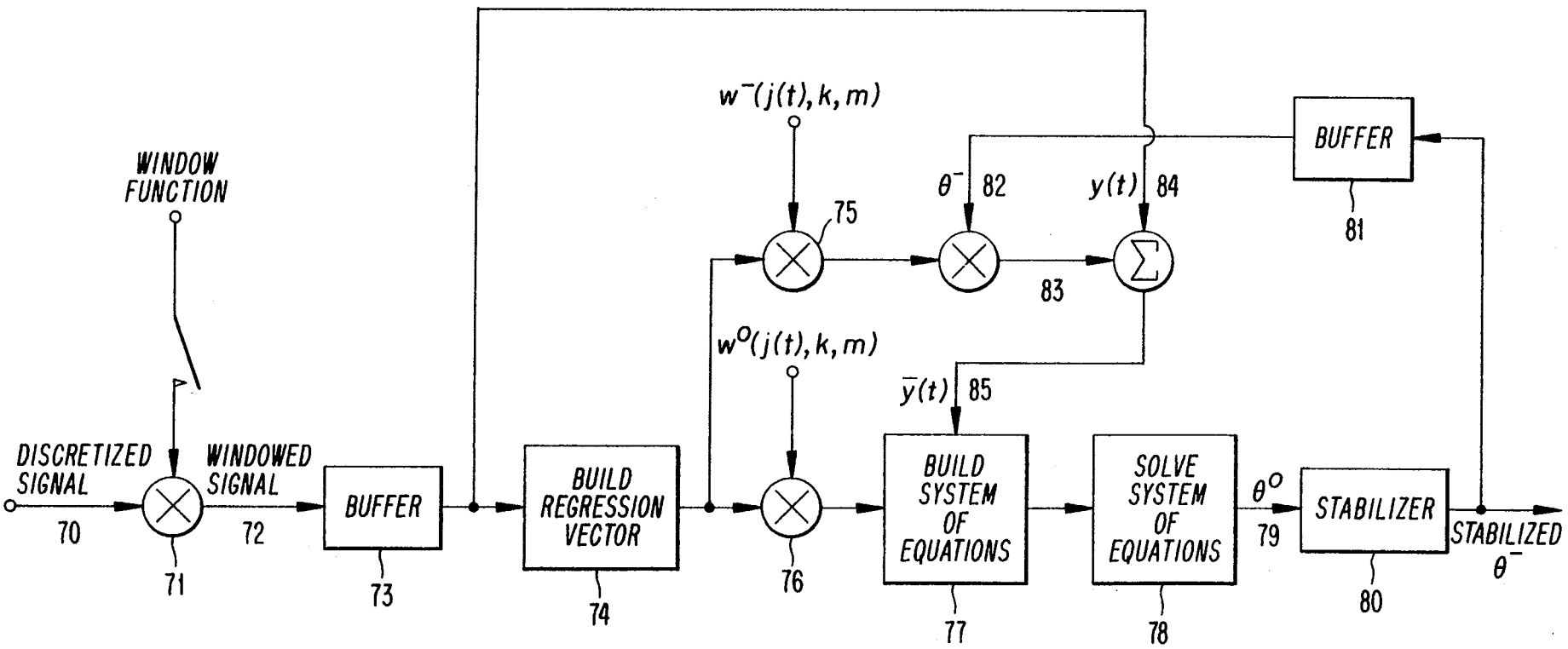
FIG. 4 illustrates a block diagram of another particular algorithm obtained from the present invention.

FIG. 4 illustrates another embodiment of the present invention in which the Linear Predictive Coding analysis method is based upon interpolation between adjacent frames. More specifically, FIG. 4 illustrates the signal analysis defined by equation (eq. 29). First, the discretized signal 70 may be multiplied with a window function signal 71 in order to obtain spectral smoothing. The resulting signal is then stored on a frame based manner in a buffer 73. The signal in buffer 73 is then used for the generation of regressor or regression vector signals 74, as defined by equation (eq. 21), utilizing a spectral smoothing parameter. The regression vector signals 74 are then multiplied with a weighting factor 76, as defined by equation (eq. 9), in order to produce a first set of signals. A linear system of equations, as defined by equation (eq. 29), is constructed from the first set of signals and a second set of signals 85, which will be defined below. The system of equations is solved to yield a parameter vector signal for the present frame 79. The stability of the spectral model is obtained by feeding the parameter vector signal through a stability correcting device 80. The stabilized parameter vector signal is fed into a buffer 81 that delays the parameter vector signal by one frame.

The second set of signals, mentioned above, are constructed by first multiplying the regression vector signals 74 with a weighting function 75, as defined by equation (eq. 8). The resulting signal is then combined with the parameter vector signal of the previous frame to produce signals 83. These signals are then combined with the signal from buffer 73 to produce the second set of signals 85.

The disclosed methods can be generalized in several directions. In this embodiment, the concentration is on modifications of the model and on the possibility to derive more efficient algorithms for calculation of the estimates.

One modification of the model structure is to include a numerator polynomial in the filter model (eq. 1) as follows $$y(t) = \frac{C(q^{-1},t)}{A(q^{-1},t)} e(t) \qquad \text{(eq. 30)}$$

where $$C(q^{-1},t) = 1 + c_1(t)q^{-1} + \ldots c_m(t)q^{-m} \qquad \text{(eq. 31)}$$

When constructing algorithms for this model, one alternative is to use so called prediction error optimization methods as described in "Theory and Practice of Recursive Identification," L. Ljung and T. Söderström, Cambridge, Mass., M. I. T. Press, Chapters 2–3, 1983, which is incorporated herein by reference.

Another modification is to regard the excitation signal, that is calculated after the LPC-analysis in CELP-coders, as known. This signal can then be used in order to re-optimize the LPC-parameters as a final step of analysis. If the excitation signal is denoted by u(t), an appropriate model structure is the conventional equation error model:

$$A(q^{-1}, t)y(t)=B(q^{-1}, t)u(t)+e(t) \qquad \text{(eq. 32)}$$

where $$B(q^{-1}, t)=b_0(t)+b_1(t)q^{-1}+\ldots +b_m(t)\, q^{-m} \qquad \text{(eq. 33)}$$

An alternative is to use a so-called output error model. This does however lead to higher computational complexity since the optimization requires that nonlinear search algorithms are used. The parameters of the B-polynomial are interpolated exactly as those of the A-polynomial as described previously. By the introduction of $$\theta^{-}=(a^{-}_1 \ldots a^{-}_n b^{-}_0 \ldots b^{-}_n)^T \qquad \text{(eq. 34)}$$

$$\theta^{0}=(a^{0}_1 \ldots a^{0}_n b^{0}_0 \ldots b^{0}_n)^T \qquad \text{(eq. 35)}$$

$$\theta^{30}=(a^{+}_1 \ldots a^{+}_n b^{+}_0 \ldots b^{+}_n)^T \qquad \text{(eq. 36)}$$

$$\phi_\rho(t)=(-\rho^{-1}y(t-1) \ldots -\rho^{-n}y(t-n)u(t) \ldots \sigma^{-n}u(t-m))^T \qquad \text{(eq. 37)}$$

it is possible to verify that equations (eq. 28) and (eq. 29) still hold with equations (eq. 34)–(eq. 37) replacing the previous expressions everywhere. The notation $\sigma$ denotes the spectral smoothing factor corresponding to the numerator polynomial of the spectral model.

Another possibility to modify the algorithms is to use interpolation other than piecewise constant or linear between the frames. The interpolation scheme may extend over more than three adjacent speech frames. It is also possible to use different interpolation schemes for different parameters of the filter model, as well as different schemes in different frames.

The solutions of equations (eq. 28) and (eq. 29) can be computed by standard Gaussian elimination techniques. Since the least squares problems are in standard form, a number of other possibilities also exist. Recursive algorithms can be directly obtained by application of the so-called matrix inversion lemma, which is disclosed in "Theory and Practice of Recursive Identification" incorporated above. Various variants of these algorithms then follow directly by application of different factorization techniques like U-D-factorization, QR-factorization, and Cholesky factorization.

Computationally more efficient algorithms to solve equations (eq. 28) and (eq. 29) could be derived (so-called "fast algorithms"). Several techniques can be used for this purpose, e.g., the algebraic technique used in "Fast calculations of gain matrices for recursive estimation schemes," L. Ljung, M. Morf and D. Falconer, *Int. J. Contr.*, vol. 27, pp. 1–19, 1978, and "Efficient solution of co-variance equations for linear prediction," M. Morf, B. Dickinson, T. Kailath and A. Vieira, *IEEE Trans. Acoust.. Speech. Signal Processing,* vol. ASSP-25, pp. 429–433, 1977, which are incorporated herein by reference. Techniques for designing fast algorithms are summarized in "Lattice Filters for Adaptive Processing," B. Friedlander, *Proc. IEEE,* Vol. 70, pp. 829–867, 1982, and the references cited therein, which are incorporated herein by reference. Recently, so-called lattice algorithms have been obtained based on a polynomial approximation of the parameters of the spectral model, (eq. 1) using a geometric argumentation, as described in "RLS Polynomial Lattice Algorithms For Modelling Time-Varying Signals," E. Karlsson, *Proc. ICASSP,* pp. 3233–3236, 1991, which is incorporated herein by reference. That approach is however not based on interpolation between parameters in adjacent speech frames. As a result, the order of the problem is at least twice that of the order of the algorithms presented here.

In another embodiment of the present invention, the time variable LPC-analysis methods disclosed herein are combined with previously known LPC-analysis algorithms. A first spectral analysis using time variable spectral models and utilizing interpolation of spectral parameters between frames is first performed. Then a second spectral analysis is performed using a time invariant method. The two methods are then compared and the method which gives the highest quality is selected.

A first method to measure the quality of the spectral analysis would be to compare the obtained power reduction when the discretized speech signal is run through an inverse of the spectral filter model. The highest quality corresponds to the highest power reduction. This is also known as prediction gain measurement. A second method would be to use the time variable method whenever it is stable (incorporating a small safety factor). If the time variable method is not stable, the time invariant spectral analysis method is chosen.

While a particular embodiment of the present invention has been described and illustrated, it should be understood that the invention is not limited thereto, since modifications may be made by persons skilled in the art. The present invention contemplates any and all modifications that fall within the spirit and scope of the underlying invention disclosed and claimed herein.

What is claimed is:

1. A method of linear predictive coding analysis and interpolation of uninterpolated input signal frames using time variable spectral models, the method comprising the steps of:

sampling a signal to obtain a series of discrete samples and constructing therefrom a series of frames;

modeling the spectrum of said signal using a filter model utilizing interpolation of parameter signals between a previous, present and next frame for forming estimated parameters;

calculating regressor signals from said estimated parameters;

smoothing the spectrum by combining the regressor signals with a smoothing parameter to obtain smoothed regressor signals;

combining said smoothed regressor signals with weighting factors to produce a first set of signals;

combining parameter signals from the previous frame with said smoothed regressor signals, a signal sample and a weighting factor to produce a second set of signals;

calculating parameter signals for the present frame and the next frame from the first and second set of signals;

determining whether the filter model is stable after each frame; and stabilizing the filter model if the filter model is determined to be unstable.

2. A method of linear predictive coding analysis and interpolation of uninterpolated input signal frames according to claim 1, wherein said filter model is a linear, time-varying all-pole filter.

3. A method of linear predictive coding analysis and interpolation of uninterpolated input signal frames according to claim 1, wherein said filter model includes a numerator.

4. A method of linear predictive coding analysis and interpolation of uninterpolated input signal frames according to claim 1, wherein said interpolation is piecewise constant.

5. A method of linear predictive coding analysis and interpolation of uninterpolated input signal frames according to claim 1, wherein said interpolation is piecewise linear.

6. A method of linear predictive coding analysis and interpolation of uninterpolated input signal frames according to claim 1, wherein said interpolation extends over more frames than said previous, present and next frames.

7. A method of linear predictive coding analysis and interpolation of uninterpolated input signal frames according to claim 1, wherein said interpolation is nonlinear.

8. A method of linear predictive coding analysis and interpolation of uninterpolated input signal frames according to claim 1, wherein spectral smoothing is obtained by prewindowing of the estimated parameters.

9. A method of linear predictive coding analysis and interpolation of uninterpolated input signal frames according to claim 1, wherein spectral smoothing is obtained by correlation weighting.

10. A method of linear predictive coding analysis and interpolation of uninterpolated input signal frames according to claim 1, wherein a Schur-Cohn-Jury test is used to determine if said model is stable.

11. A method of linear predictive coding analysis and interpolation of uninterpolated input signal frames according to claim 1, wherein the stability of said model is determined by calculating reflection coefficients and examining the reflection coefficients sizes.

12. A method of linear predictive coding analysis and interpolation of uninterpolated input signal frames according to claim 1, wherein the stability of said model is determined by calculation of poles.

13. A method of linear predictive coding analysis and interpolation of uninterpolated input signal frames according to claim 1, wherein said model is stabilized by pole-mirroring.

14. A method of linear predictive coding analysis and interpolation of uninterpolated input signal frames according to claim 1, wherein said model is stabilized by bandwidth expansion.

15. A method of linear predictive coding analysis and interpolation of uninterpolated input signal frames according to claim 1, wherein said signal frame is a speech frame.

16. A method of linear predictive coding analysis and interpolation of uninterpolated input signal frames according to claim 1, said signal frame is a radar signal frame.

17. A method of linear predictive coding analysis and interpolation of uninterpolated input signal frames according to claim 1, wherein said parameter signals for the present frame and the next frame are calculated using Gaussian elimination.

18. A method of linear predictive coding analysis and interpolation of uninterpolated input signal frames according to claim 1, wherein said parameter signals for the present frame and the next frame are calculated using Gaussian elimination with LU-decomposition.

19. A method of linear predictive coding analysis and interpolation of uninterpolated input signal frames according to claim 1, wherein said parameter signals for the present frame and the next frame are calculated using QR-factorization.

20. A method of linear predictive coding analysis and interpolation of uninterpolated input signal frames according to claim 1, wherein said parameter signals for the present frame and the next frame are calculated using U-D-factorization.

21. A method of linear predictive coding analysis and interpolation of uninterpolated input signal frames according to claim 1, wherein said parameter signals for the present frame and the next frame are calculated using Cholesky-factorization.

22. A method of linear predictive coding analysis and interpolation of uninterpolated input signal frames according to claim 1, wherein said parameter signals for the present frame and the next frame are calculated using a Levenberg-Marquardt method.

23. A method of linear predictive coding analysis and interpolation of uninterpolated input signal frames according to claim 1, wherein said parameter signals for the present frame and the next frame are calculated using a recursive formulation.

24. A method of linear predictive coding analysis and interpolation of uninterpolated input signal frames according to claim 1, wherein said parameter signals are a-parameters.

25. A method of linear predictive coding analysis and interpolation of uninterpolated input signal frames according to claim 1, wherein said parameter signals are reflection coefficients.

26. A method of linear predictive coding analysis and interpolation of uninterpolated input signal frames according to claim 1, wherein said parameter signals are area coefficients.

27. A method of linear predictive coding analysis and interpolation of uninterpolated input signal frames according to claim 1, wherein said parameter signals are log-area parameters.

28. A method of linear predictive coding analysis and interpolation of uninterpolated input signal frames according to claim 1, wherein said parameter signals are log-area ratio parameters.

29. A method of linear predictive coding analysis and interpolation of uninterpolated input signal frames according to claim 1, wherein said parameter signals are formant frequencies and corresponding bandwidths.

30. A method of linear predictive coding analysis and interpolating of uninterpolated input signal frames according to claim 1, wherein said parameter signals are arcsine parameters.

31. A method of linear predictive coding analysis and interpolation of uninterpolated input signal frames according to claim 1, wherein said parameter signals are autocorrelation-parameters.

32. A method of linear predictive coding analysis and interpolation of uninterpolated input signal frames according to claim 1, wherein said parameter signals are line spectral frequencies.

33. A method of linear predictive coding analysis and interpolation of uninterpolated input signal frames according to claim 1, wherein an additional known input signal to said spectral model is utilized.

34. A method of linear predictive coding analysis and interpolation of uninterpolated input signal frames according to claim 1, wherein said filter model is non-linear in the parameter signals.

35. A method of linear predictive coding analysis and interpolation of uninterpolated input signal frames using time variable spectral models, the method comprising:

sampling a signal to obtain a series of discrete samples and constructing therefrom a series of frames;

modeling the spectrum of said signal using a filter model utilizing interpolation of parameters between a previous, present and next frame for forming estimated parameters;

calculating regressor signals from said estimated parameters;

smoothing the spectrum by combining the regressor signals with a smoothing parameter to obtain smoothed regressor signals;

combining said smoothed regressor signals with a weighting factor to produce a first set of signals;

combining parameter signals from the previous frame with said smoothed regressor signals, a signal sample and a weighting factor to produce a second set of signals;

calculating parameter signals for the present frame from the first and second set of signals;

determining whether the filter model is stable after each frame;

stabilizing the filter model if the filter model is determined to be unstable.

36. A method of linear predictive coding analysis and interpolation of uninterpolated input signal frames according to claim 35, wherein said filter model is a linear, time-varying all-pole filter.

37. A method of linear predictive coding analysis and interpolation of uninterpolated input signal frames according to claim 35, wherein said filter model includes a numerator.

38. A method of linear predictive coding analysis and interpolation of uninterpolated input signal frames according to claim 35, wherein said interpolation is piecewise constant.

39. A method of linear predictive coding analysis and interpolation of uninterpolated input signal frames according to claim 35, wherein said interpolation is piecewise linear.

40. A method of linear predictive coding analysis and interpolation of uninterpolated input signal frames according to claim 35, wherein said interpolation extends over more frames than said previous, present and next frames.

41. A method of linear predictive coding analysis and interpolation of uninterpolated input signal frames according to claim 35, wherein said interpolation is non-linear.

42. A method of linear predictive coding analysis and interpolation of uninterpolated input signal frames according to claim 35, wherein spectral smoothing is obtained by prewindowing of the estimated parameters.

43. A method of linear predictive coding analysis and interpolation of uninterpolated input signal frames according to claim 35, wherein spectral smoothing is obtained by correlation weighting.

44. A method of linear predictive coding analysis and interpolation of uninterpolated input signal frames according to claim 35, wherein a Schur-Cohn-Jury test is used to determine if said model is stable.

45. A method of linear predictive coding analysis and interpolation of uninterpolated input signal frames according to claim 35, wherein the stability of said model is determined by calculating reflection coefficients and examining the reflection coefficients sizes.

46. A method of linear predictive coding analysis and interpolation of uninterpolated input signal frames according to claim 35, wherein the stability of said model is determined by calculation of poles.

47. A method of linear predictive coding analysis and interpolation of uninterpolated input signal frames according to claim 35, wherein said model is stabilized by pole-mirroring.

48. A method of linear predictive coding analysis and interpolation of uninterpolated input signal frames according to claim 35, wherein said model is stabilized by bandwidth expansion.

49. A method of linear predictive coding analysis and interpolation of uninterpolated input signal frames according to claim 35, wherein said signal frame is a speech frame.

50. A method of linear predictive coding analysis and interpolation of uninterpolated input signal frames according to claim 35, wherein said signal frame is a radar signal frame.

51. A method of linear predictive coding analysis and interpolation of uninterpolated input signal frames according to claim 35, wherein said parameter vector signal for the present frame is calculated using Gaussian elimination.

52. A method of linear predictive coding analysis and interpolation of uninterpolated input signal frames according to claim 35, wherein said parameter signal for the present frame is calculated using Gaussian elimination with LU-decomposition.

53. A method of linear predictive coding analysis and interpolation of uninterpolated input signal frames according to claim 35, wherein said parameter signal for the present frame is calculated using QR-factorization.

54. A method of linear predictive coding analysis and interpolation of uninterpolated input signal frames according to claim 35, wherein said parameter signal for the present frame is calculated using U-D-factorization.

55. A method of linear predictive coding analysis and interpolation of uninterpolated input signal frames according to claim 35, wherein said parameter signal for the present frame is calculated using Cholesky-factorization.

56. A method of linear predictive coding analysis and interpolation of uninterpolated input signal frames according to claim 35, wherein said parameter signal for the present frame is calculated using a Levenberg-Marquardt method.

57. A method of linear predictive coding analysis and interpolation of uninterpolated input signal frames according to claim 35, wherein said parameter signal for the present frame is calculated using a recursive formulation.

58. A method of linear predictive coding analysis and interpolation of uninterpolated input signal frames according to claim 35, wherein said parameter signal is an a-parameter.

59. A method of linear predictive coding analysis and interpolation of uninterpolated input signal frames according to claim 35, wherein said parameter signal is a reflection coefficient.

60. A method of linear predictive coding analysis and interpolation of uninterpolated input signal frames according to claim 35, wherein said parameter signal is an area coefficient.

61. A method of linear predictive coding analysis and interpolation of uninterpolated input signal frames according to claim 35, wherein said parameter signal is a log-area parameter.

62. A method of linear predictive coding analysis and interpolation of uninterpolated input signal frames according to claim 35, wherein said parameter signal is a log-area ratio parameter.

63. A method of linear predictive coding analysis and interpolation of uninterpolated input signal frames according to claim 35, wherein said parameter signal is a formant frequency and a corresponding bandwidth.

64. A method of linear predictive coding analysis and interpolation of uninterpolated input signal frames according to claim 35, wherein said parameter signal is an arcsine parameter.

65. A method of linear predictive coding analysis and interpolation of uninterpolated input signal frames according to claim 35, wherein said parameter signal is an autocorrelation-parameter.

66. A method of linear predictive coding analysis and interpolation of uninterpolated input signal frames according to claim 35, wherein said parameter signal is a line spectral frequency.

67. A method of linear predictive coding analysis and interpolation of uninterpolated input signal frames according to claim 35, wherein an additional known input signal to said spectral filter model is utilized.

68. A method of linear predictive coding analysis and interpolation of uninterpolated input signal frames according to claim 35, wherein said filter model is non-linear in the parameter signals.

69. A method of signal coding, the method comprising:

determining a first spectral analysis of signal frames using time variable spectral models and utilizing interpolation of spectral parameters between frames;

determining a second spectral analysis using time invariant spectral models;

comparing the first analysis to the second spectral analyses to determine which spectral analysis has the highest quality; and selecting the spectral analysis with the highest quality to code the signal.

70. A method of signal coding according to claim 69, wherein said spectral analyses are compared by measuring the signal energy reduction after synthesis filtering with said time variable and time invariant spectral models, and choosing the spectral analysis that gives the highest signal energy reduction.

71. A method of signal coding according to claim 70, further comprising the step of:

determining is said first spectral analysis gives a stable model, wherein said spectral analysis is selected as said first spectral analysis if said first spectral analysis gives a stable model, and said second spectral analysis is selected if said first spectral analysis given an unstable model.

* * * * *